United States Patent [19]

Tu

[11] Patent Number: 5,062,499

[45] Date of Patent: Nov. 5, 1991

[54] SIDE RAILS FASTENING MECHANISM FOR TELESCOPIC ALUMINUM STEP LADDERS

[76] Inventor: Ching-Chuan Tu, No. 24, Feng-Shu Lane, Feng-Shu Li, Nan-Tun District, Taichung, Taiwan

[21] Appl. No.: 596,706

[22] Filed: Oct. 10, 1990

[51] Int. Cl.[5] ..... E06C 1/30; E06C 7/50

[52] U.S. Cl. ..... 182/166; 182/195; 182/209

[58] Field of Search ..... 182/195, 166, 167, 209

[56] References Cited

U.S. PATENT DOCUMENTS

| | | | |
|---|---|---|---|
| 1,337,666 | 4/1920 | Remalia | 182/166 |
| 1,712,942 | 5/1929 | Smith | 182/195 |
| 2,194,856 | 3/1940 | Kostuk | 182/195 |
| 2,542,398 | 2/1951 | Crumpton | 182/195 |
| 2,827,216 | 3/1958 | Napolitano | 182/195 |
| 2,899,009 | 8/1959 | Roth | 182/166 |
| 2,993,561 | 7/1961 | Watson | 182/195 |

*Primary Examiner*—Reinaldo P. Machado
*Attorney, Agent, or Firm*—Bacon & Thomas

[57] ABSTRACT

A side rails fastening mechanism for securing the frame fractions of the side rails of a telescopic aluminum step ladders in an extended or collapsed position, comprising an insert block fixedly secured inside each frame fraction at a lower position with a rung secured thereto and a locking bolt fastened inside a transverse hole thereon and pushed by a compression spring to insert through a mounting hole on the frame fraction disposed at an inner side into a lower or upper locating hole on the frame fraction disposed at an outer side so as to firmly secure two connected frame fractions in an extended or collapsed condition.

6 Claims, 4 Drawing Sheets

SIDE RAILS FASTENING MECHANISM FOR TELESCOPIC ALUMINUM STEP LADDERS

BACKGROUND OF THE INVENTION

The present invention relates to telescopic aluminum step ladders, and more particularly relates to a side rails fastening mechanism for securing the side rails of a telescopic aluminum step ladders into shape when it is in use, or into collapsed condition to minimize space occupation when it is not in use.

Regular aluminum step ladders are generally of fixed type, the front and rear pair of side rails of which may be closed up togethe but can not be respectively collapsed in vertical direction to greatly reduce space occupation when not in use. There is a kind of folding aluminum step ladders which can be folded up to reduce space occupation when not in use. Still there is provided a kind of telescopic aluminum step ladders the side rails of which are each comprised of a plurality frame fractions that slide one inside another. However, regular folding or telescopic aluminum step ladders are not very satisfactory in use. They may be complicated in structure and difficult to set up and collapse or not very stable for supporting heavy load. The present invention has been accomplished to eliminate the aforesaid disadvantages of the conventional aluminum step ladders.

SUMMARY OF THE INVENTION

It is one object of the present invention to provide a side rails fastening mechanism for a telescopic aluminum step ladders permitting a telescopic aluminum step ladders to be conveniently set up or received into a collapsed condition to greatly reduce its space occupation. It is another object of the present invention to provide a side rails fastening mechanism for a telescopic aluminum step ladders, which is safety in use and can support a heavy load. It is still another object of the present invention to provide a side rails fastening mechanism for a telescopic aluminum step ladders which is suitable for mass production.

BRIEF DESCRIPTION OF THE DRAWINGS

The present invention will now be described by way of example with reference to the annexed drawings, in which.

DETAILED DESCRIPTION OF THE PREFERRED EMBODIMENT

Figure 1:
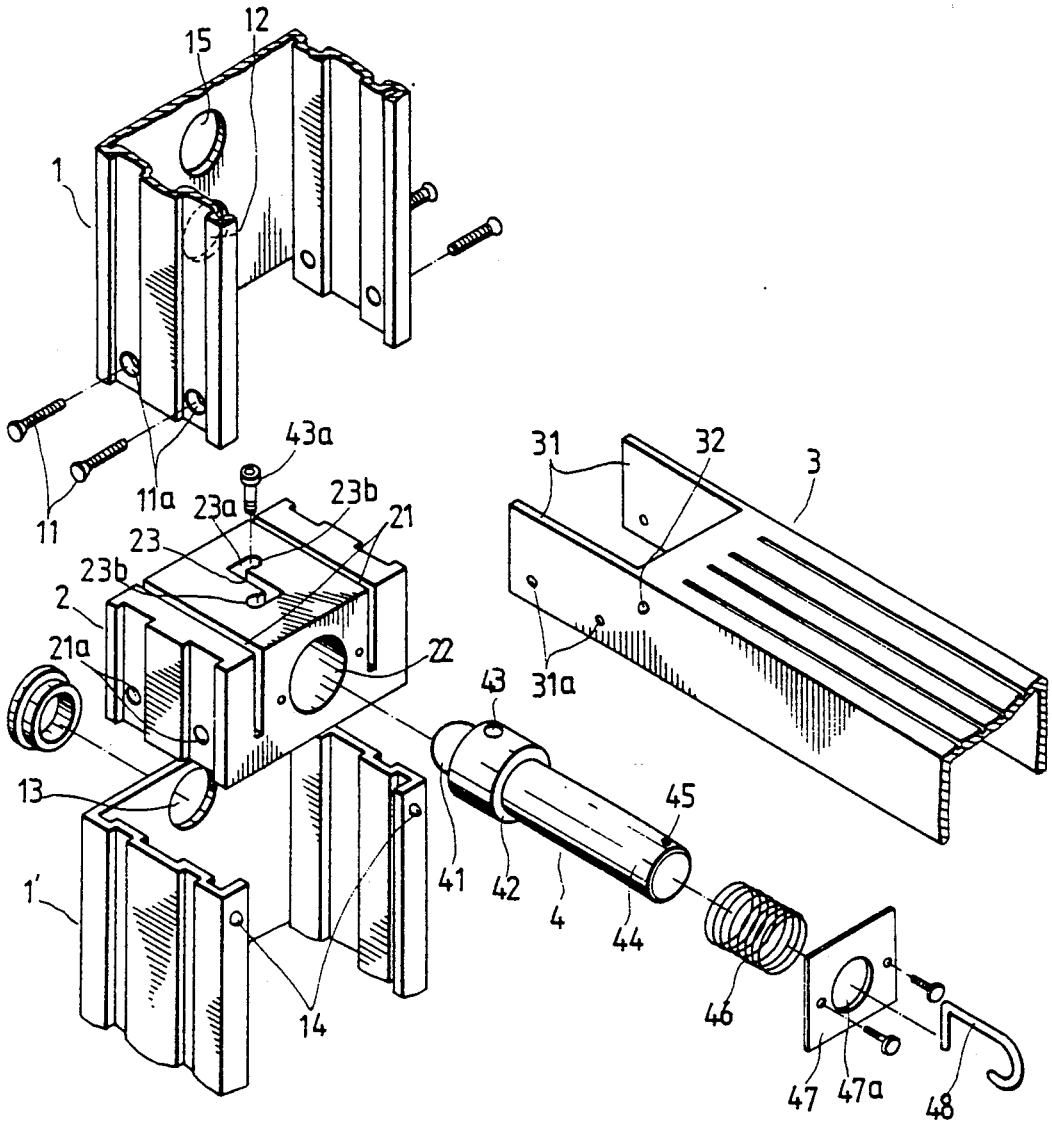
FIG. 1 is a perspective dismantled view of the preferred embodiment of the present invention.

Turning now to the annexed drawings in greater detail and referring first to FIG. 1, a telescopic aluminum ladders is comprised of a front pair of side rails and a rear pair of side rails. Each side rail is comprised of a plurality of M-shaped frames 1 in size properly reduced in succession and respectively disposed to slide with one inside another. Each M-shaped frame 1 is attached with an insert block 2 internally at a lower end. The insert block 2 has two parallel grooves 21 on the top and spaced from each other at such a range that a rung 3 can be secured to the insert block 2 with its two side projections 31 respectively inserted in the two parallel grooves 21. By fastening screws from both opposite sides of the M-shaped frame 1 into bolt holes 11*a*, 21*a* and 31*a*, a rung 3 and an insert block 2 can be tightly secured the M-shaped frame 1. After a rung 3 and an insert block 2 are respectively secured to a M-shaped frame 1, a M-shaped frame 1 can be moved to slide vertically inside another M-shaped frame 1' of size relatively larger.

Figure 2:
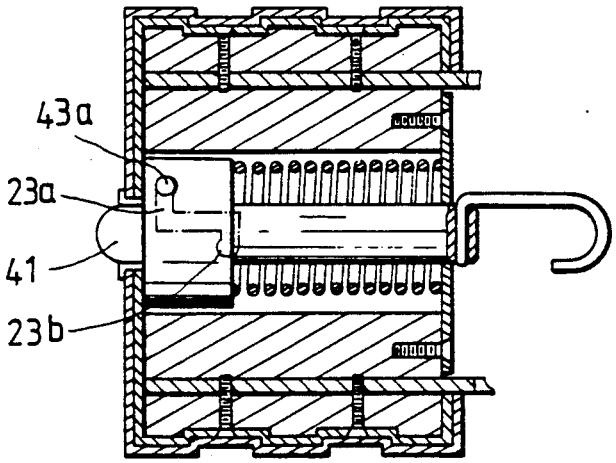
FIG. 2 is a perspective sectional view of the preferred embodiment of the present invention, in which the lock bolt is locked in a locking position.
Figure 4:
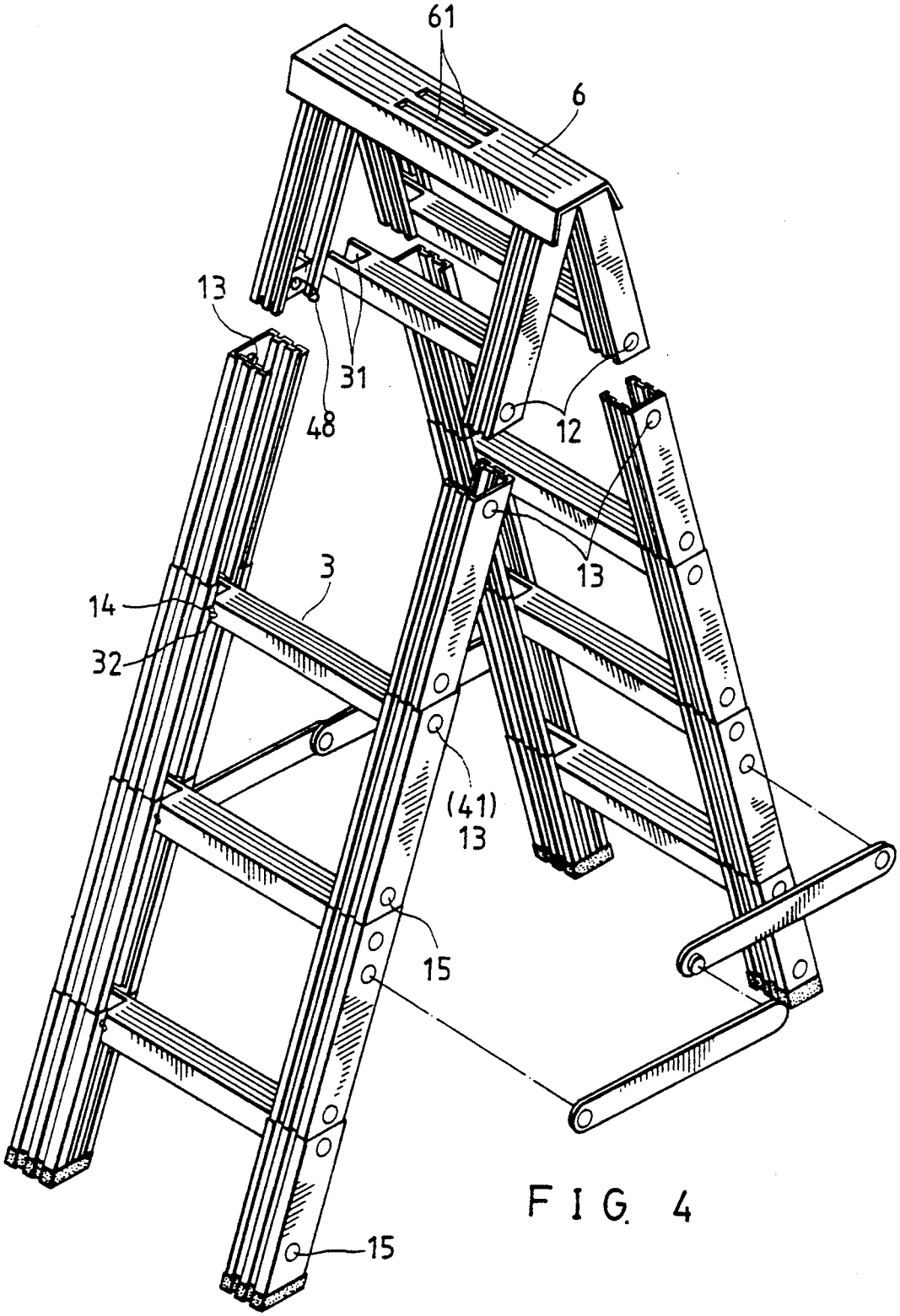
FIG. 4 is a perspective view of a telescopic aluminum step ladders according to the present invention when it is in an extended position.

In oder to prevent a M-shaped frame 1 from breaking away when it is moved to the upper limit inside another M-shaped frame 1', a suitable measure must be taken. An insert block 2 further comprises a through-hole 22 transversely piercing therethrough between the two parallel grooves 21 thereof and disposed in alignment with a through-hole 12 made on each M-shaped frame 1 at a lower position. There is provided a locking bolt 4 fastened in the through-hole 22 of each insert block 2. The locking bolt 4 has a raised stop ring 42 near its front end 41 with a bolt hole 43 made thereon, and a notch 45 near its rear end 44 with a hook-shaped pull bar 48 fastened therein. A compression spring 46 is received inside the through-hole 22 of the insert block 2 and stopped between the locking bolt 4 and a stop plate 47 which is fixedly secured to the insert block 2 with its center hole 47*a* aimed at the through-hole 22 of the insert block 2 permitting the rear end 44 of the locking bolt 4 to extend out. Therefore, when a M-shaped frame 1 at the inner side slides to the upper limit inside another M-shaped frame 1' at the outer side, the locking bolt 4 which is inserted in the through-hole of the insert block 2 which is secured to the inner-sided M-shaped frame 1 is simultaneously moved upward. Once the lower through hole 12 of the inner-sided M-shaped frame 1 is disposed in alignment with the locating hole 13 on the outer-sided M-shaped frame 1, the locking bolt 4 is immediately forced by the connected compression spring 46 to insert through the lower through-hole 12 of the inner-sided M-shaped frame into the locating hole 13 of the outer-sided M-shaped frame 1' to lock up the inner-sided M-shaped frame 1 with the outer-sided M-shaped frame 1' in a standing position (see FIGS. 2 and 4).

Figure 3:
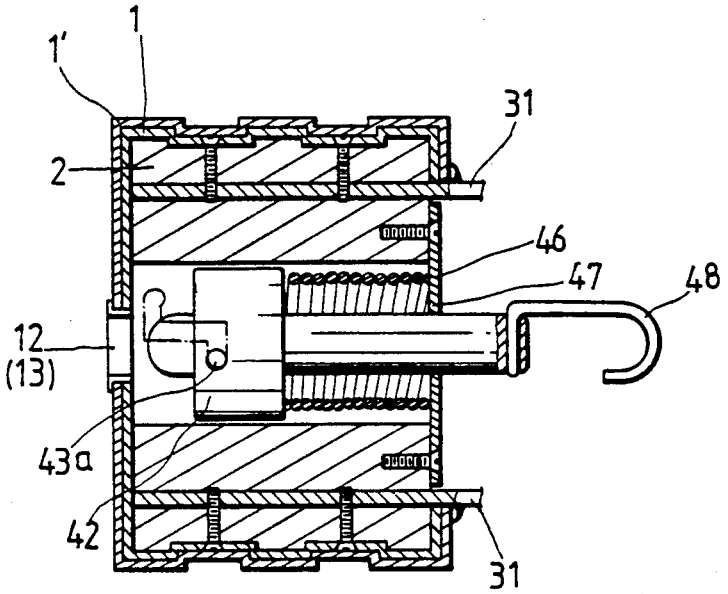
FIG. 3 is a perspective sectional view of the preferred embodiment of the present invention, in which the lock bolt is removed from is locking position.

When to collapse the M-shaped frames of the side rails with one received inside another, it is operated according to following procedure. Pull the hook-shaped pull bar 48 to move the front end 41 of the locking bolt 4 out of the locating hole 13 on the outer-sided M-shaped frame 1' (see FIG. 3) permitting the inner-sided M-shaped frame 1 to freely slide inside the outer-sided M-shaped 1'. As soon as the inner-sided M-shaped frame 1 is moved to its lower limit, it becomes firmly stopped at the insert block 2 which is fastened in the outer-sided M-shaped frame 1'.

In order to stably maintain the aluminum step ladders in shape when it is in an extended condition for service, each locking bolt 4 must be fixedly secured in position. In the present invention, an insert block 2 can be fastened in the M-shaped frames either of the left-sided rail or the right-sided rail. The insert block 2 further comprises a Z-shaped slot 23 on the top and in communication with the transverse through-hole 22 thereof. Therefore, a screw bolt 43*a* can be inserted through the Z-shaped slot 23 and fastened in the bolt hole 43 on the raised stop ring 42 of the locking bolt 4. Because the two opposite ends 23*a*, are respectively extending outward in direction vertical to the moving direction of the locking bolt 4, the locking bolt 4 can be moved, by rotating the pull bar 47 clockwise or counter-clockwise when the front end 41 of the locking bolt 4 is inserted through an inner-sided M-shaped frame 1 in the locating hole 13 of an outer-sided M-shaped frame 1' or moved away from the locating hole 13 of an outer-sided M-shaped frame 1', to push the screw bolt 43*a* inside either one of the two opposite ends 23*a* of the Z-shaped slot 23. Inside each opposite end 23*a* of the the Z-shaped slot 23, there is a notch 23*b* made on its inner wall surface in direction same as the moving direction of the locking bolt 4 so that the screw bolt 43*a* can be firmly retained therein.

Please refer to FIG. 1 again. Each M-shaped frame 1 further comprises two raised portions 14 on the two opposite bottom ends thereof at an upper position corresponding two raised portions 32 on the two opposite side walls of each rung 3. Therefore, when an inner-sided M-shaped frame 1 is moved to the top inside an outer-sided M-shaped frame 1' with the front end 41 of the locking bolt 4 inserted in the locating hole 13, the two raised portions 14 of an outer-sided M-shaped frame 1' are respectively stopped against the two raised portions 32 on the rung 3 so as to confine the inner-sided M-shaped frame 1 inside the outer-sided M-shaped frame 1'. The raised portions 14 and 32 can be made through point welding process after all M-shaped frames and rungs 3 are respectively connected together to set up a step ladders.

Figure 5:
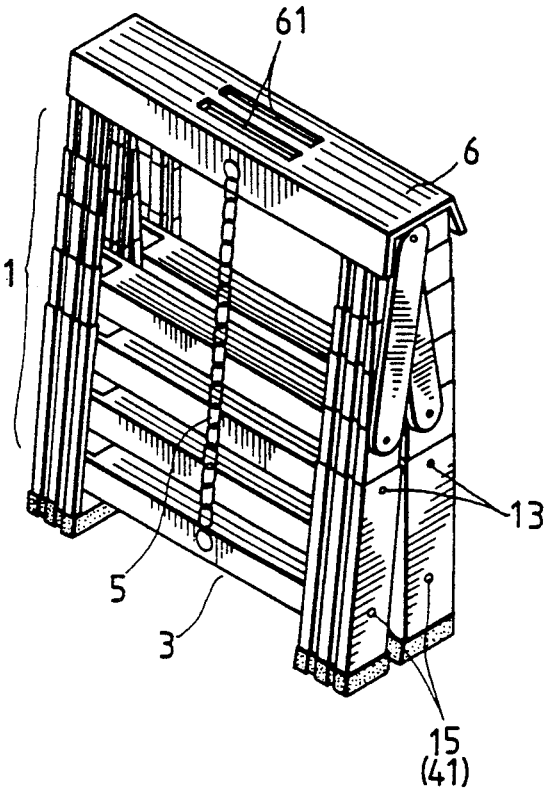
FIG. 5 is a perspective view of the telescopic aluminum step ladders of FIG. 4 when it is in a collapsed position.

Further, each M-shaped frame 1 comprises another hole 15 at location slightly above the lower through-hole 12 thereof. Therefore, when an inner-sided M-shaped frame 1 is moved downward inside an outer-sided M-shaped frame 1', the locking bolt 4 can be forced by the compression spring 46 to insert in the hole 15 (see FIGS. 1, 2 and 5) to firmly maintain the collapsed M-shaped frames in position.

Referring to FIG. 5 again, when an aluminum step ladders of the present invention is collapsed, it can be firmly secured in a collapsed condition by a chain cable 5. Further, two elongated, parallel holes 61 made be made on the top plate 6 of the aluminum step ladder convenient for holding of the hand.

I claim:

1. A side rails fastening mechanism for securing the frame fractions of the side rails of a telescopic aluminum step ladders in an extended or collapsed position, comprising an insert block fixedly secured inside each frame fraction at a lower position with a locking bolt fastened inside a transverse hole thereon and pushed by a compression spring to insert through a mounting hole on the frame fraction disposed at an inner side into a locating hole on the frame fraction disposed at an outer side so as to firmly secure two connected frame fraction in an extended position; and characterized in that:

said insert block has two parallel grooves on the top and spaced from each other at such a range that a rung can be secured thereto with its two opposite side projections respectively inserted in the two parallel grooves, and fastening screws can be inserted from the two opposite sides of each frame fraction to fixedly secure a rung and said insert block to a frame fraction permitting a frame fraction to freely slide inside another.

2. The fastening mechanism of claim 1, wherein said rung can be fastened in said two parallel grooves of said insert block and fixedly secured to a frame fraction by block by fastening lock pins from the two opposite sides of a frame fraction into said insert block and said two opposite side projections of said rung.

3. The fastening mechanism of claim 1, wherein said insert block has a Z-shaped slot at the top and disposed in communication with the transverse hole thereof, permitting a screw bolt to move therein, said screw bolt being secured to said locking bolt with its top end projecting over the top surface of said insert block and carried by said locking bolt to move inside said Z-shaped slot, said Z-shaped slot having two opposite ends respectively extending outward in two opposite directions with a notch each made thereon for retaining said screw bolt.

4. The fastening mechanism of claim 1, which further comprises a pull bar fastening in said locking bolt at the rear end for pulling said locking bolt to move away from the upper or lower locating hole of said frame fraction.

5. The fastening mechanism of claim 1, wherein each frame fraction further has another locating hole right above the mounting hole thereof for fastening therein of the locking bolt inserted in the insert block fastened in another frame fraction to firmly secure two connected frame fractions in a collapsed position.

6. The fastening mechanism of claim 1, wherein said frame fractions have each two raised portions made thereon at an inner side on the two opposite vertical ends thereof, said two raised portions being carried to respectively stop against two raised portions made on said two opposite side projections of said rung so as to protect the inner-sided frame fraction from disengaging from the outer-sided frame fraction when the inner-sided frame fraction is moved upward to extend out of the outer-sided frame fraction.

* * * * *